US008857611B2

(12) United States Patent
Thorburn et al.

(10) Patent No.: US 8,857,611 B2
(45) Date of Patent: Oct. 14, 2014

(54) PACKAGE OF FOLDED SHEET PRODUCTS AND METHOD FOR FILLING A DISPENSER

(75) Inventors: Annie Sporre Thorburn, Göteborg (SE); Robert Kling, Göteborg (SE)

(73) Assignee: SCA Hygiene Products AB, Göteborg (SE)

( * ) Notice: Subject to any disclaimer, the term of this patent is extended or adjusted under 35 U.S.C. 154(b) by 0 days.

(21) Appl. No.: 14/126,772

(22) PCT Filed: Jun. 15, 2011

(86) PCT No.: PCT/SE2011/050740

§ 371 (c)(1), (2), (4) Date: Dec. 16, 2013

(87) PCT Pub. No.: WO2012/173534

PCT Pub. Date: Dec. 20, 2012

(65) Prior Publication Data

US 2014/0116913 A1 May 1, 2014

(51) Int. Cl.

| | |
|---|---|
| ***B65D 85/00*** | (2006.01) |
| ***B65D 75/02*** | (2006.01) |
| ***B65D 83/08*** | (2006.01) |
| ***B65D 65/10*** | (2006.01) |
| ***A47K 10/42*** | (2006.01) |

(52) U.S. Cl.

CPC ..... *B65D 65/10* (2013.01); *B65D 75/02* (2013.01); *B65D 83/0805* (2013.01); *A47K 10/424* (2013.01); *Y10S 206/812* (2013.01)

USPC ..... 206/233; 206/494; 206/812

(58) Field of Classification Search

USPC ..... 206/449, 555, 556, 494, 804, 812, 581, 206/231, 233; 53/473, 381.1, 381.4

See application file for complete search history.

(56) References Cited

U.S. PATENT DOCUMENTS 3,124,298 A * 3/1964 Repko ..... 383/207
3,207,361 A 9/1965 Marcalus (Continued)

FOREIGN PATENT DOCUMENTS

EP 0 779 053 A1 6/1997
WO WO 96/03069 A1 2/1996

OTHER PUBLICATIONS

International Search Report (PCT/ISA/210) mailed on Feb. 21, 2012, by the Swedish Patent Office as the International Searching Authority for International Application No. PCT/SE2011/050740.

(Continued)

*Primary Examiner* — Jacob K Ackun

(74) *Attorney, Agent, or Firm* — Buchanan Ingersoll & Rooney PC

(57) ABSTRACT

A package of folded sheet products includes a stack of the sheet products, and a package wrapper, which surrounds the stack and holds the stack together. The stack includes a start sheet product at a start end of the stack, and an end sheet product at an opposite end of the stack. The package wrapper (3) includes a first end portion (12) and a second end portion (13), which end portions (11, 12) are mutually joined by where the end portions (11, 12) are overlapping and with the first end portion (12) arranged outside the second end portion (13). The second end portion (13) of the package wrapper (3) is free from direct attachment to the stack, and the first end portion (12) of the package wrapper (3) is joined with the start sheet product (4) by second attachment means (22).

18 Claims, 5 Drawing Sheets

(56) References Cited

U.S. PATENT DOCUMENTS

| | | | | |
|---|---|---|---|---|
| 5,033,620 | A * | 7/1991 | De Luca | 206/494 |
| 6,609,616 | B2 * | 8/2003 | Dilnik et al. | 206/494 |
| 6,926,149 | B2 * | 8/2005 | Tippey | 206/494 |
| 7,695,037 | B2 * | 4/2010 | Rhodes | 294/156 |
| 8,162,142 | B2 * | 4/2012 | Kobayashi | 206/494 |
| 2002/0046550 | A1 * | 4/2002 | O'Connor et al. | 53/429 |
| 2002/0144924 | A1 * | 10/2002 | Johnson et al. | 206/494 |
| 2004/0245140 | A1 | 12/2004 | Larsson et al. | |
| 2009/0236952 | A1 | 9/2009 | Giulio | |
| 2010/0243504 | A1 * | 9/2010 | Long et al. | 206/494 |
| 2010/0288666 | A1 | 11/2010 | Kobayashi | |

OTHER PUBLICATIONS

Written Opinion (PCT/ISA/237) mailed on Feb. 21, 2012, by the Swedish Patent Office as the International Searching Authority for International Application No. PCT/SE2011/050740.

* cited by examiner

PACKAGE OF FOLDED SHEET PRODUCTS AND METHOD FOR FILLING A DISPENSER

TECHNICAL FIELD

The present invention relates to a package of folded sheet products, in particular hand wipes, made of tissue paper or nonwoven, which package comprising a stack of said sheet products, and a package wrapper, which surrounds said stack and holds said stack together, said stack comprises a start sheet product at a start end of said stack, and an end sheet product at an opposite end of said stack, said package wrapper comprises a first end portion and a second end portion, which end portions are mutually joined by first attachment means at a first attachment location where said end portions are overlapping and with said first end portion arranged outside said second end portion, said first attachment location is arranged such that a release tab for removal of said package wrapper is formed by a end piece of said first end portion, and a free extremity of said release tab is arranged at said start end of said stack.

BACKGROUND ART

Dispensers located in restrooms and other places where absorbent articles for drying hands are desired may contain folded sheet products. The folded sheet products may come in a package containing a stack of folded sheet products where the outer wrapping has to be removed prior to loading the dispenser. After removing the outer wrapping the stack of folded sheet products has to be handled gently in order for the sheet products not to fall out from the stack. This makes handling of such a stack of folded sheet products difficult to handle and loading of such dispensers may be time consuming for a custodian or janitor responsible for loading dispensers.

WO 96/03069 discloses a toilet paper package being contained by a wrapper placed around the package in order to hold the package together. The package is intended for placing in a dispenser placed in a toilet roll holder. Loading the dispenser takes place by placing the package in the dispenser, tearing the package wrapper by means of a tearing thread, and/or perforations in the wrapper, feeding an end of the wrapper through a dispensing opening and closing the dispenser.

The problems with the solution according to WO 96/03069 is that the package wrapper has to be removed using a large number of steps, that manufacturing of the package is relatively complex and therefore less economical, and that the package appears to be suitable only for a specific type of dispenser.

There is thus a need for an improved package of folded sheet products removing the above mentioned disadvantages.

SUMMARY

An object of the present disclosure is to provide an inventive package of folded sheet products where the previously mentioned problems are partly avoided. In one embodiment a second end portion of a package wrapper is free from direct attachment to said stack, and wherein a first end portion of said package wrapper is joined with a start sheet product by second attachment means at a second attachment location.

The disclosure relates to a package of folded sheet products, in particular hand wipes, made of tissue paper or nonwoven, which package comprising a stack of said sheet products, and a package wrapper, which surrounds said stack and holds said stack together, said stack comprises a start sheet product at a start end of said stack, and an end sheet product at an opposite end of said stack, said package wrapper comprises a first end portion and a second end portion, which end portions are mutually joined by first attachment means at a first attachment location where said end portions are overlapping and with said first end portion arranged outside said second end portion, said first attachment location is arranged such that a release tab for removal of said package wrapper is formed by an end piece of said first end portion, and a free extremity of said release tab is arranged at said start end of said stack, wherein said second end portion of said package wrapper is free from direct attachment to said stack, and wherein said first end portion of said package wrapper is joined with said start sheet product by second attachment means at a second attachment location.

The advantage of having such a package wrapper is that it allows refilling of a dispenser by simply inserting a package into the dispenser, possibly with a protective outer wrapper removed, without further actions required by the person loading the package, thus facilitating simplified handling of the package during loading. A package wrapper according to the invention does not require inclusion of any wrapper tearing means, such as tear threads, wrapper perforations or other type of wrapper weakening means for tearing the wrapper apart, and thereby providing access to the sheet products of the package. Instead, the wrapper according to the invention allows removal of the wrapper without tearing the wrapper. This inventive and advantageous technical effect is provided by mutually joining the first and second end portions of the package wrapper, whilst said second end portion of said package wrapper is free from direct attachment to said stack. Due to this configuration, the wrapper may slide of the stack by simply pulling the release tab through the dispensing opening of the dispenser, in which the package is placed. There is no longer a need to tear the wrapper apart, and the wrapper does consequently not require inclusion of any wrapper tearing means. Removal of the inventive package wrapper by sliding and without tearing the wrapper apart is possibly because the second end portion of said package wrapper is free from direct attachment to said stack. There is thus no attachment between the second end portion to the stack that may hinder a sliding motion of the second end portion from an original position, around the opposite end of the stack, and subsequently out through the dispensing opening. As a result, a user does not require access to any tear threads for tearing of the package wrapper within the dispenser, thereby providing less constraints on the type of dispenser used. Furthermore, the user does no longer have to perform several steps for making the stack ready to use, such as finding the tearing threads, pulling the tearing threads to tear the wrapper apart, finding a free end of the wrapper, and pulling the free end to remove the wrapper. Moreover, due to the joining of the first end portion of the package wrapper with the start sheet product by second attachment means at a second attachment location, automatic withdrawal of the start sheet product upon removal of the package wrapper is facilitated. As a consequence, the start sheet product will be available to a user directly upon removal of the package wrapper. Hence, the invention provides an improved package with simplified handling and reduced manufacturing costs.

The package wrapper provides a clear instruction on how to orient the package within the dispenser, thereby eliminating the risk of arranging the sheet products erroneously, such as upside down. Moreover, multiple packages may be stacked on top of each other without further actions required during loading of the dispenser. When the first package is depleted it is easy to start usage of the next package by simply pulling the release tab of the package wrapper of the next package, which release tab will become visible and easily accessible upon depletion of the previously used package. The remaining package wrapper further allows easy removal of packages that have not yet been started because the package wrapper is still mounted and intact, thus still holding the stack of sheet products in the package together.

The first attachment means of the package may be configured to break upon exerting a pull force on said release tab, facilitating removal of said package wrapper from said stack.

This results in a simplified and cost effective manufacturing process of the package, because no additional manufacturing steps, such as perforation, must be undertaken to realise a removable wrapper. After the first attachment means has been broken, the entire package wrapper may be slide off the stack, without any tearing of the wrapper itself.

The package wrapper may be formed of a thin strip of material whose width is smaller than a width of the stack.

This reduces sliding friction between the wrapper and an inner surface of the dispenser during removal of the wrapper, in particular when the package wrapper is arranged to correspond with an enlarged part of a dispensing opening. A smaller package wrapper saves material which results in reduced material costs. The width of the wrapper may be adjusted depending on the type of sheet product that is used, what kind of material is used for the package wrapper, and the form and size of the dispensing opening.

The stack is provided with one or more package wrappers holding the stack together. Two or more package wrappers arranged side by side and offset from each other may advantageously be provided when higher compression of the stack is desirable. Higher stack compression results in reduced size of the package, leading to reduced costs for transportation, storage and handling of the package. Multiple package wrappers may also lead to a more uniform height of the package because a more uniform compression of the stack is obtainable. Using a single substantially centrally arranged package wrapper, the side portions of the stack may be less compressed that the central portion. When two or more package wrappers are provided around the stack, they are preferably arranged in parallel planes sideways offset from each other, and preferably symmetrically around a centre of the stack for obtaining a uniform compression of the stack.

The first attachment location may be arranged at a start end of the stack, i.e. at a surface defined by the start sheet product. This location of the first attachment means ensures that mainly peel stress is exerted on the first attachment means upon pulling the release tab. Peel stress reduces bond strength of attachments means compared with shear stress. This location further result in a near minimal amount of required package wrapper material and reduced level of pulling force required to break the first attachment means. Peel stress may be an approximation of stress that is exerted at an angle, preferably perpendicular to the planes comprising the attachment location.

The first attachment location may alternatively be arranged at a side surface of said stack that is formed by a long side of sheet products and associated with said second end portion of said package wrapper. This location of the first attachment means ensures that only peel stress is exerted on the first attachment means upon pulling the release tab, but the amount of package wrapper material required is slightly increased.

The end piece of a first end portion may be folded back and attached to an outer surface of the first end portion of the package wrapper by third attachment means at a third attachment location for ensuring that the free extremity of the release tab is always arranged at the start end of the package.

This effectively limits the range of motion of the release tab and prevents the extremity of the release tab from relocating to a side surface of the package, such that user, custodian or janitor may always easily find and access the release tab.

The third attachment means may be configured to break prior to the first attachment means upon exerting said pull force on said release tab.

This may provide elongation of the release tab for improved grip of the release tab. The sequence of breakage may be adapted by relative position of the first and third attachment locations, and/or differential attachment strength. This differential attachment strength may be achieved by different release agents or different attachment areas or any other known technique for varying attachment strengths of this kind.

Any of the first, second, and third attachment means may comprise an adhesive material, in particular hot-melt adhesive, or double sided fastening tape, or heat welding with or without external filler, or mechanical bonding, in particular form locking attachment.

All of the above are examples of different alternatives to attachment means, and different types of attachment means may be selected for the different attachment locations, depending on the specific circumstances.

Each of the sheet products may have an oblong rectangular shape with two opposite long sides and two opposite short sides, wherein said package wrapper extends over either the short sides or the long sides.

This presents alternative wrapping embodiments. The choice of which embodiment to use may depend on the kind of paper used and the type of dispenser the paper is used with.

The first attachment location may be arranged at least 20 mm from the extremity of the first end portion, preferably at least 35 mm from the extremity of the first end portion, and more preferably at least 50 mm from the extremity of the first end portion.

This facilitates improved grasping of said release tab. The measurement is performed from the farthest edge of the end piece of the end portion with the end portion in a straight position.

The height of the package is at least 15 cm, and preferably at least 20 cm. Without a package wrapper a stack may be limited in height while still being able to be handled as an integral unit using a single hand. For the invention to be most effective a larger stack may be desired. The height of the package is measured as the distance from the start sheet to the opposing end sheet in compressed mode. The compression may arise during manufacturing or transportation. The height of the package may be varied depending on the type of sheet product that is used and may also depend on the type of dispenser the package is intended for.

The package is arranged to be placed within a sheet product dispenser with the start end facing a dispensing opening of the sheet product dispenser.

The disclosure also relates to a sheet product dispenser comprising a housing for holding a stack of folded sheet products, wherein said housing comprising a front wall, a rear wall, two outer side walls, an upper wall and a support surface for said stack, and wherein a dispensing opening is provided in said upper wall or said support surface for dispensing said sheet products to a consumer, where said sheet product dispenser holds a package of folded sheet products as described above.

The dispensing opening of the sheet product dispenser may also exhibit a generally elongated rectangular or elliptical shape, and at least one region of said dispensing opening may be provided with an enlarged opening having a width in the direction of said elongation, which is larger than the width of the package wrapper.

Having a dispensing opening in a shape as described above reduces friction between the package wrapper and the dispensing opening during removal of wrapper making it easier to remove the wrapping.

The disclosure also relates to a method for filling a sheet product dispenser with folded sheet products where the method comprising the steps of:

providing a dispenser comprising a housing for holding a stack of folded sheet products, wherein said housing comprising a front wall, a rear wall two outer side walls, an upper wall and a support surface for said stack, and wherein a dispensing opening is provided in said upper wall or said support surface for dispensing said sheet products to a consumer;

providing a package of folded sheet products, in particular hand wipes, made of tissue paper or nonwoven, which package comprising a stack of said sheet products, and a package wrapper, which surrounds said stack and holds said stack together, said stack comprises a start sheet product at a start end of said stack, and an end sheet product at an opposite end of said stack, said package wrapper comprises a first end portion and a second end portion, which end portions are mutually joined by first attachment means at a first attachment location where said end portions are overlapping and with said first end portion arranged outside said second end portion, wherein said first attachment location is arranged such that a release tab for removal of said package wrapper is formed by a end piece of said first end portion, wherein a free extremity of said release tab is arranged at said start end of said package, wherein said second end portion of said package wrapper is free from direct attachment to said stack, and wherein said first end portion of said package wrapper is joined with said start sheet product by second attachment means at a second attachment location;

arranging said package unopened within said dispenser, such said release tab is accessible to a user when said start sheet product is arranged next to said dispensing opening; and pulling said release tab and removing said package wrapper from said stack via said dispensing opening.

Suitable material for the package wrapper may be paper, nonwoven, plastic, PE-laminate and other suitable materials used either by themselves or in laminates. The materials may be treated with different types of surface agents. Using laminates or paper or nonwoven treated on one or both sides may allow for different strengths of the attachment means of the different attachment locations. It may also provide a package wrapper that is easier to pull and that give rise to less friction against a dispenser or against the sheet products of the stack.

BRIEF DESCRIPTION OF THE DRAWINGS

Embodiments of the present invention will now be described in detail with reference to the figures, wherein.

DETAILED DESCRIPTION

Figure 1:
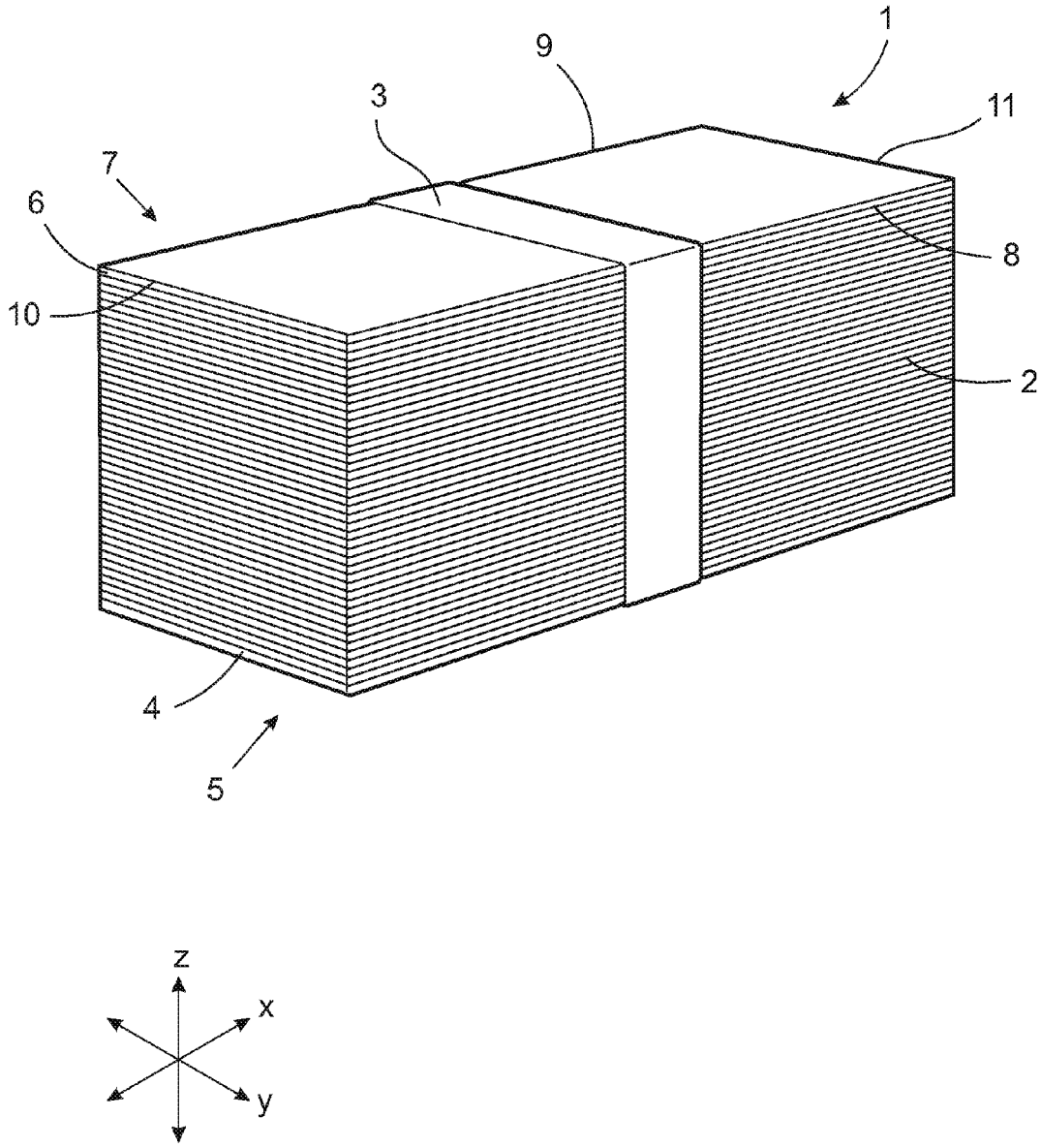
FIG. 1 schematically shows a package according to an embodiment of the invention.

FIG. 1 schematically shows a package 1 according to an embodiment of the invention. The package comprises a stack 2 of sheet products made of for instance of tissue paper or nonwoven. A package wrapper 3 surrounds the stack 2 holding it together. The package wrapper 3 is free from perforations or other types of weakening that may simplify tearing the package wrapper 3 apart, thereby allowing a simplified and more economical manufacturing of the package. The stack 2 of sheet products comprises a start sheet product 4 located at a start end 5 of the stack 2 of sheet products and an end sheet product 6 located at an opposite end 7 of the stack 2 of sheet products. In FIG. 1 the start sheet product 4 is located at the bottom of the stack 2 of sheet product and the end sheet product 6 is located at the top of the stack 2 of sheet products. This may of course be the other way around depending on if the stack 2 of sheet products is placed in a dispenser with a dispensing opening located at a top surface of the dispenser. The sheet products in the stack 2 may be interfolded in any suitable way, for instance by C-fold, W-fold or Z-fold. The sheet products in the stack 2 may also be placed on top of each other without interfolding.

The sheet products have a first long side 8, a second long side 9, a first short side 10 and a second short side 11, and the package wrapper 3 extends over said long sides 8, 9 of each sheet product. The main surfaces of the sheet products are substantially rectangular and said long sides 8, 9 extend along a x-direction, whereas said short sides 10, 11 extend along a y-direction. The thickness of each sheet product extends in a z-direction, which corresponds to the height direction of the stack 2.

Figure 2:
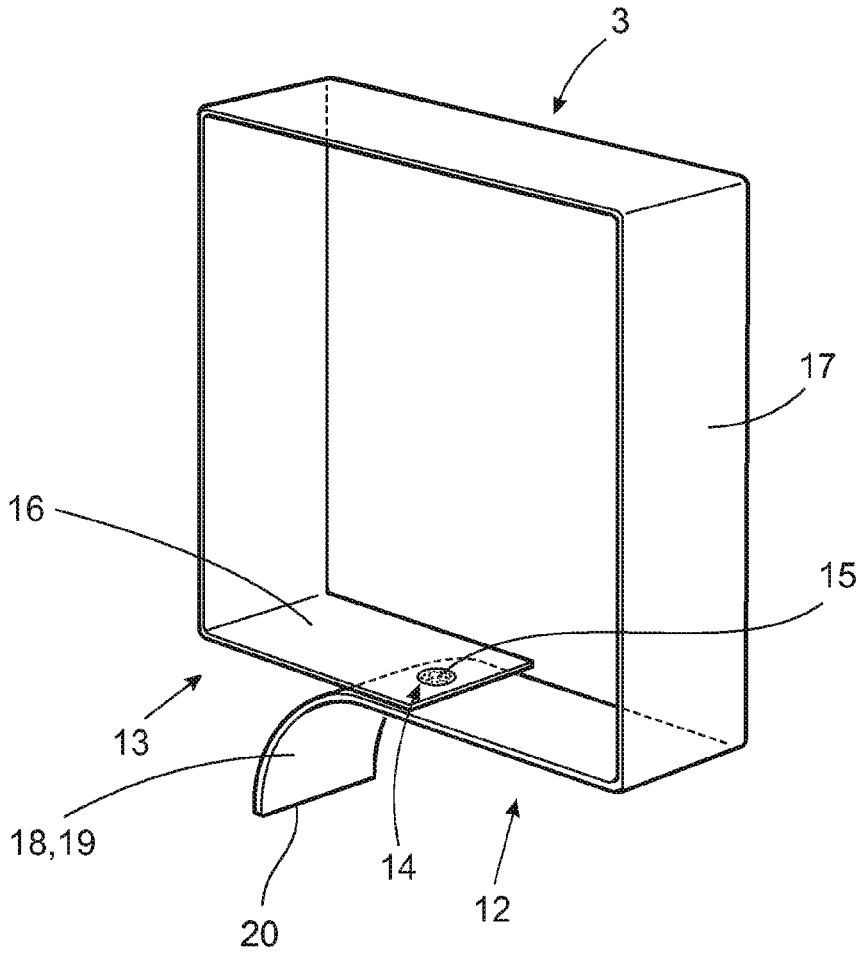
FIG. 2 schematically shows a package wrapper according to an embodiment of the invention.

FIG. 2 schematically shows the package wrapper 3 according to an embodiment of the invention. FIG. 2 shows the general shape of the package wrapper 3. The package wrapper comprises a first end portion 12 and a second end portion 13. The first and second end portion 12, 13 of the package wrapper may be defined by the respective end regions of the package wrapper 3, or the first end portion 12 may correspond to a first half of the package wrapper 3, and the second end portion 13 may correspond to a second half of the package wrapper 3. The first and second end portions 12, 13 of the package wrapper 3 overlap, and said end portions 12, 13 are joined at a first attachment location 14 by means of a first attachment means 15. The first end portion 12 is arranged outside the second end portion 13 at the first attachment location 14, and a part of the first end portion 12 extends a certain distance beyond the first attachment location 14. The package wrapper 3 further comprises an interior surface 16 facing toward the inside of the package wrapper 3 and an exterior surface 17 facing away from the package wrapper 3.

The part of the first end portion 12 that extend beyond the first attachment location 14, i.e. the end piece 18 of the first end portion 12 constitutes a release tab 19 for removal of the package wrapper 3. The outermost edge of the release tab 19 and thus the outermost edge of the first end portion 12 forms a free extremity 20 and is arranged at the start end 5 of the stack 2.

As seen from FIG. 2 the second end portion 13 of the package wrapper 3 is free from direct attachment to the stack 2. This means that the second end portion 13 of the package wrapper 3 is not directly attached to the stack by means of an attachment means or similar. The second end portion 13 is however indirectly attached to the stack 2 by means of attachment of the first end portion 12 to the stack 2. This thus forms an indirect attachment of the second end portion 13 to the stack 2. Observing the second end portion 13 in isolation from the first end portion 12, no attachment exists between the second end portion 13 and the stack 2.

The location of the first attachment location 14 is merely shown as an illustration. The first attachment location 14 may for instance be placed at a side surface of the stack 2 associated with the second end portion 13 of the package wrapper 3. The first attachment means may comprise an adhesive material, in particular hot-melt adhesive, or double sided fastening tape, or heat welding with or without external filler, or mechanical bonding, in particular form locking attachment, or the like. The area of attachment may have any shape, such as circular, elliptical or band-shaped, and the area of attachment may be extend over the entire width of the package wrapper, or just a part of the width. The area of attachment may preferably be elongated in the direction of the package wrapper for reducing the required pulling force to be exerted on the release tab, because an elongated area of attachment facilitates improved peeling stresses, and consequently reduced breaking level of the first attachment means 15.

The first attachment location 14 may be arranged at least 20 mm from the free extremity 20 of the first end portion 12, preferably at least 35 mm from the free extremity 20 of the first end portion 12 and more preferably at least 50 mm from the free extremity 20 of the first end portion 12. The first attachment location 14 may further be arranged at an end region of the second end portion 13, preferably near or at an extremity of the second end portion 13.

Figure 3:
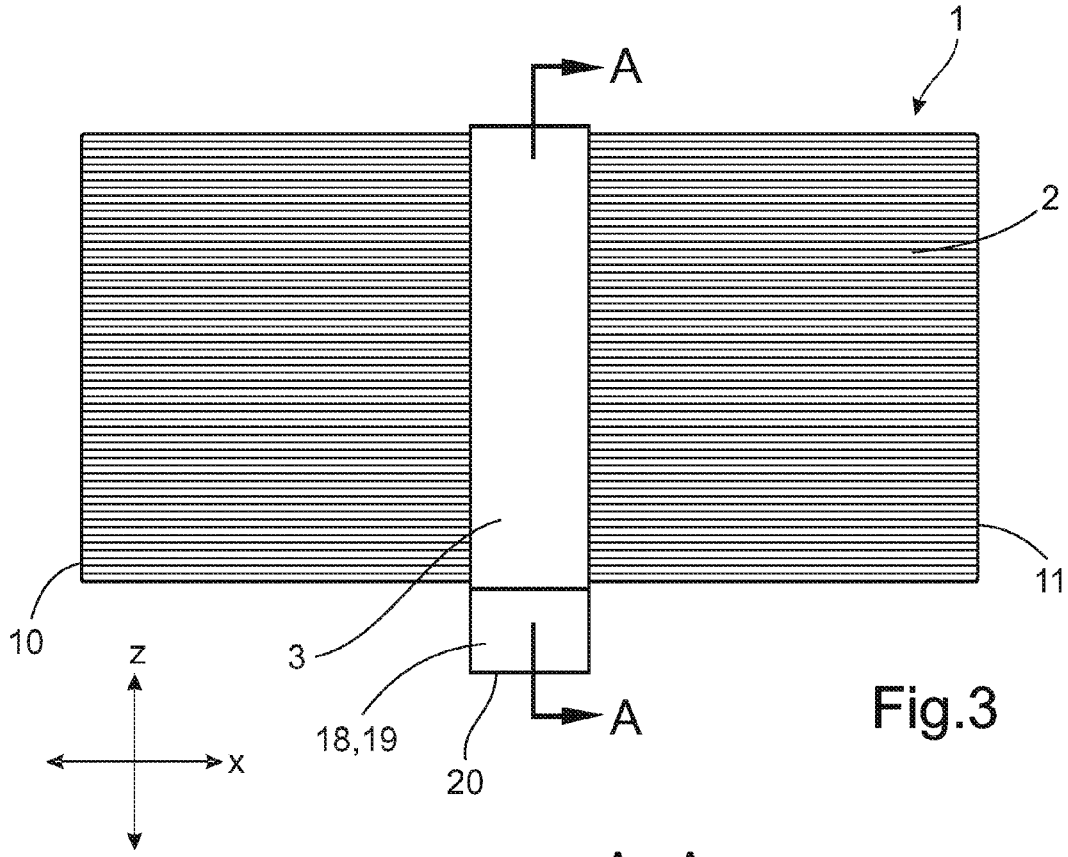
FIG. 3 schematically shows a front view of a package according to an embodiment of the invention.

FIG. 3 schematically shows a front view of the package 1. From FIG. 3 it can be seen that the package wrapper 3 is formed of a thin strip of material whose width is smaller than a width of the stack 2. The width of the stack 2 is defined as the length of the first long side 8 and the second long side 9. It may also be defined as the length of the first short side 10 and the second short side 11. The release tab 19 and the free extremity 20 are also shown.

Figure 4:
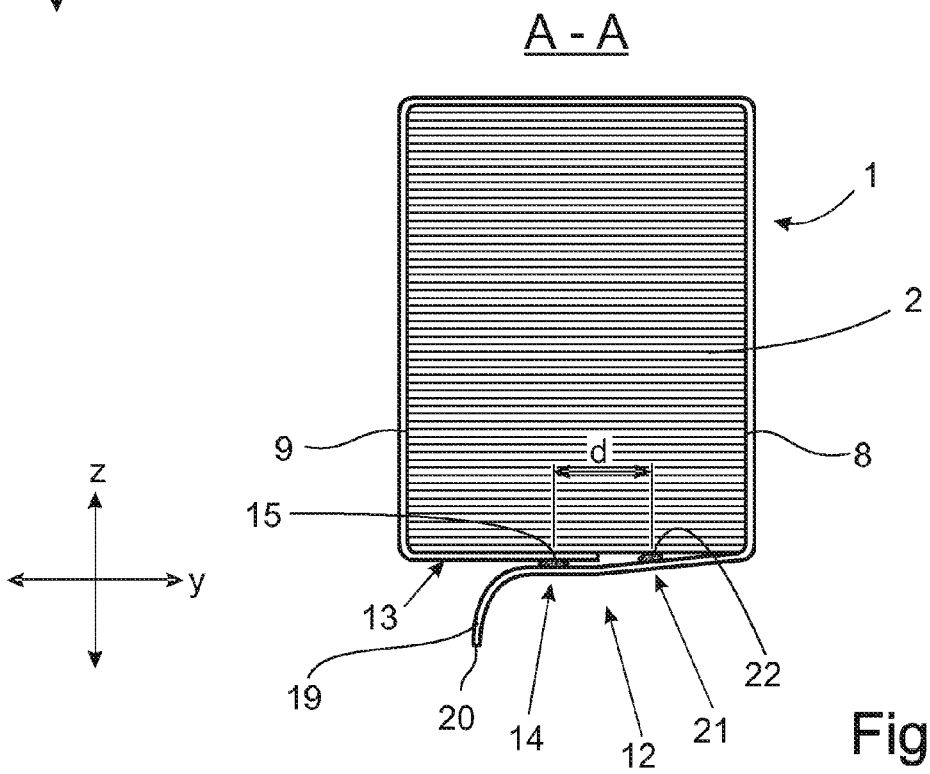
FIG. 4 schematically shows a view of a package along the cut A-A of FIG. 3 according to a first aspect of an embodiment of the invention.

FIG. 4 schematically shows the package 1 along the cut A-A of FIG. 3. The package wrapper 3 encloses the stack 2 holding it together enabling an easier handling of the package 1. One example of the relation between the first end portion 12, the second end portion 13 and the first attachment location 14 is shown. As stated in relation to FIG. 2 the second end portion 13 of the package wrapper 3 is free from direct attachment to the stack 2. Exerting a pull force on the free extremity 20 of the release tab 19 will break the first attachment means 15 at the first attachment location 14 between the first end portion 12 and the second end portion 13. Further pulling the release tab 19 enables the package wrapper 3 to be pulled around the package 1 readying the package for use. Pulling of the release tab 19 is intended to be performed mainly in a direction perpendicular to the exterior surface 17 of the package wrapper 3, such that a pull force gives rise to peel stress in the first attachment means 15. This ensures that the first attachment means 15 break easily. The pull direction may of course vary a certain extent depending on the shape of the dispensing opening, against which the exterior surface 17 of the package wrapper 3 abuts, and the first attachment location 14. The first attachment location 14 and the length of the release tab 19 are preferably selected to allow the release tab 19 to automatically protrude out through the dispensing opening of the dispenser after inserting a package 1 into the dispenser.

FIG. 4 further shows that the package 1 according to an embodiment of the invention is provided with second attachment means 22 at a second attachment location 21. The second attachment means 22 joins the first end portion 12 of the package wrapper 3 with the start sheet product 4. The second end portion 13 is free from the direct attachment to the stack 2. When the free extremity 20 of the release tab 19 is pulled the first attachment means 15 are designed to break, allowing the package wrapper 3 to be slide over the stack 2 and out via the dispensing opening. The second attachment means 22 is configured to remain intact during said removal of the package wrapper 3, and ensures thus that the start sheet product 4 follows the package wrapper 3 when the package wrapper 3 is pulled out through the dispensing opening. It is vital that the start sheet product is attached to the end of the package wrapper 3 having the release tab 19 for ensuring that the start sheet product 4 not have to be slide around the stack together with the package wrapper 3, because this would likely lead to increased required pulling force and possible jam of first sheet product 4 within the sheet product dispenser 26.

The second attachment location 21 may be arranged at any location at the start end of the stack 2 where the interior surface 16 of the package wrapper 3 faces the start sheet product 4. The second attachment location 21 is normally arranged circumferentially offset from the first attachment location 14 with a distance d, which here is measured in the y-direction. This arrangement is a consequence of lack of direct contact between the interior surface 16 of the first end portion 12 and the start sheet product 4 at the first attachment location 14, due to the overlapping relationship of the first and second end portions 12, 13 where the first end portion 12 is arrange outside the second end portion 13. This is of course mainly valid for a package wrapper 3 having a uniform width and with the first and second end portions 12, 13 aligned. The circumferentially offset arrangement of the first and second attachment locations 14, 21 leads to an improved and simplified removal of the package wrapper 3, because breaking of the first attachment means 15 is less influenced by motion of the start sheet product 14, which motion at least partly results from the attachment of the first end portion 12 to the start sheet product 14.

Figure 5:
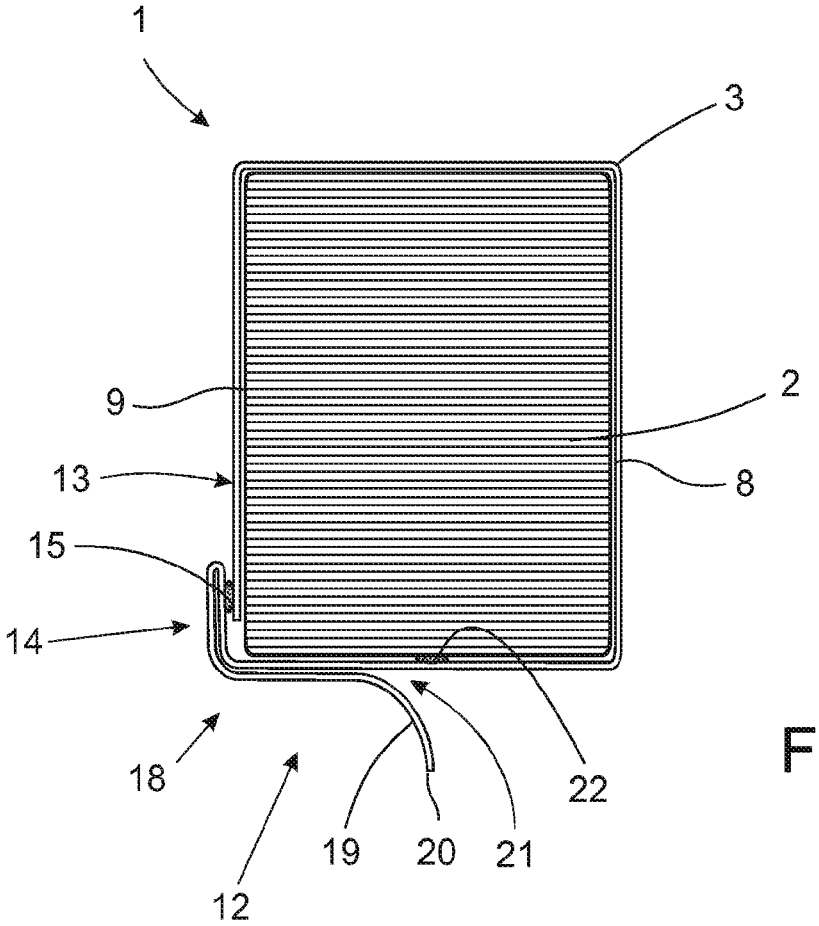
FIG. 5 schematically shows a view of a package along the cut A-A of FIG. 3 with an alternative arrangement of the package wrapper according to an embodiment of the invention.

FIG. 5 shows a package of folded sheet products similar to FIG. 4, but with an alternative arrangement of the first attachment location 14. The first attachment location 14 is here arranged at a side of the stack 2 that is formed by the second long sides 9 of the sheet products of the stack 2, and close to the start sheet product 4. This location of the first attachment means 15 ensures that only peel stress is exerted on the first attachment means 15 upon pulling the release tab 19. The amount of package wrapper material required is however slightly increased due to an increased length of the package wrapper. The second attachment location 21 of the second attachment means 22 is arranged any location at the start end of the stack 2.

Figure 6:
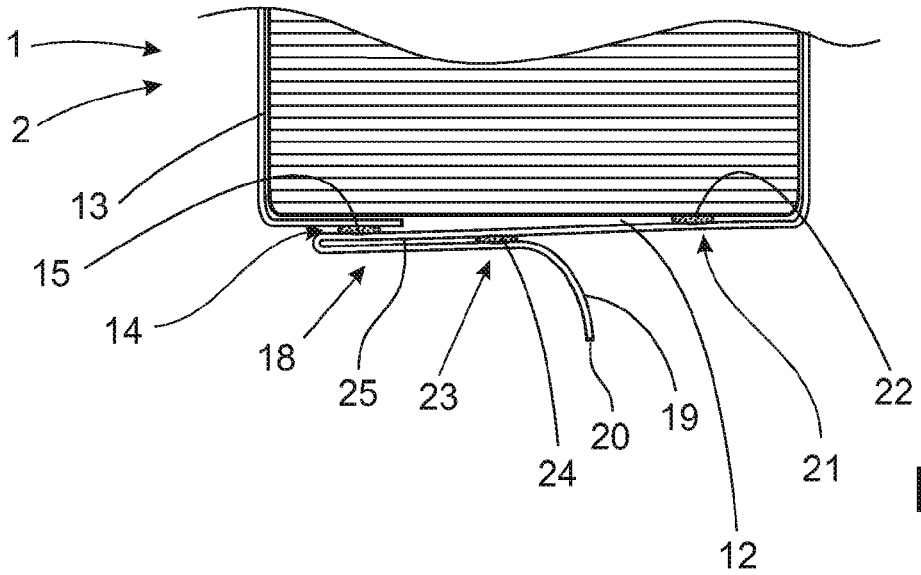
FIG. 6 schematically shows a detail of the package wrapper according to a second aspect of an embodiment of the invention.

FIG. 6 schematically shows a package 1 according to a second aspect of an embodiment of the invention. Besides the first attachment location 14 and the second attachment location 21 as described in conjunction with FIGS. 4 and 5, a third attachment location 23 is formed by folding the end piece 18 of the first end portion 12 and attaching the end piece 18 of the package wrapper 3 to the outer surface 25 of the first end portion 12. The part of the first end portion 12 that extends beyond the third attachment location 23 forms the release tab 19 having a free extremity 20. The third attachment location 23 is advantageously arranged at a side of the stack 2 formed by the start sheet product 4, such that the free extremity 20 of the package wrapper 3 is more likely being accessible from the dispensing opening. The third attachment means 24 is designed to break before the first attachment means 15. This aspect of the invention provides an increased length of the end piece 18 for improved grip thereof, without risking that the free extremity 20 is inaccessible from the dispensing opening. In this aspect of the invention the second end portion 13 is also free from the direct attachment to the stack 2. The package as illustrated in FIG. 4 or FIG. 5 may of course equally be provided with third attachment means 24 at a third attachment location 23, as described above.

In the above description the package wrapper 3 is described as extending over the first long side 8 and the second long side 9. The package wrapper may alternatively extend over the first short side 10 and the second short side 11. The features described above are valid for both alternatives.

Figure 7:
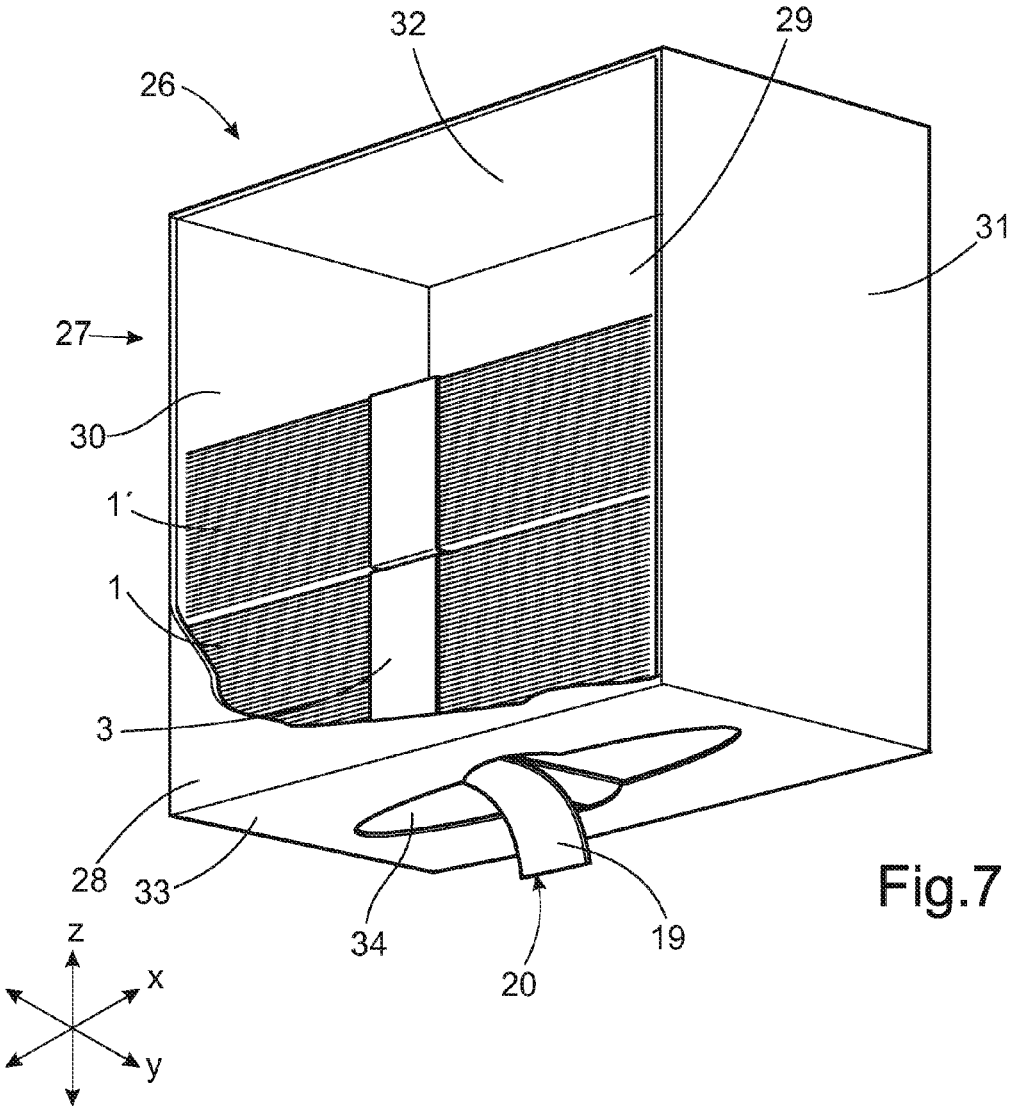
FIG. 7 schematically shows a dispenser loaded with a package according to an embodiment of the invention.

FIG. 7 schematically shows a sheet product dispenser 26 being loaded with two similar packages 1, 1' of sheet products according to an embodiment of the invention. The sheet product dispenser 26 comprises a housing 27 having a front wall 28, a rear wall 29, a first outer side wall 30, a second outer side wall 31, an upper wall 32 and a support surface 33 located at the bottom of the sheet product dispenser 26. A part of the front wall is schematically removed in order to illustrate the location of the packages 1, 1'. The sheet product dispenser 26 further comprises a dispensing opening 34 located either in the upper wall 32 of the sheet product dispenser 26 or in the support surface 33 of the sheet product dispenser 26. In FIG. 7 the dispensing opening 34 is located in the support surface 33 in order for extraction of sheet products downwards. In the case where the dispensing opening 34 is located in the upper wall 32, the support surface 33 of the sheet product dispenser 26 may have means for pushing the stack 2 towards the upper wall 32 in order for sheet products to be available to extract upwards through the dispensing opening 34. As can be seen from FIG. 7 two packages 1, 1' are loaded in the sheet product dispenser 26 with the release tab 19 of the lower package 1 extending from the dispensing opening 34, and being ready to be pulled by a user, custodian or janitor.

Figure 8:
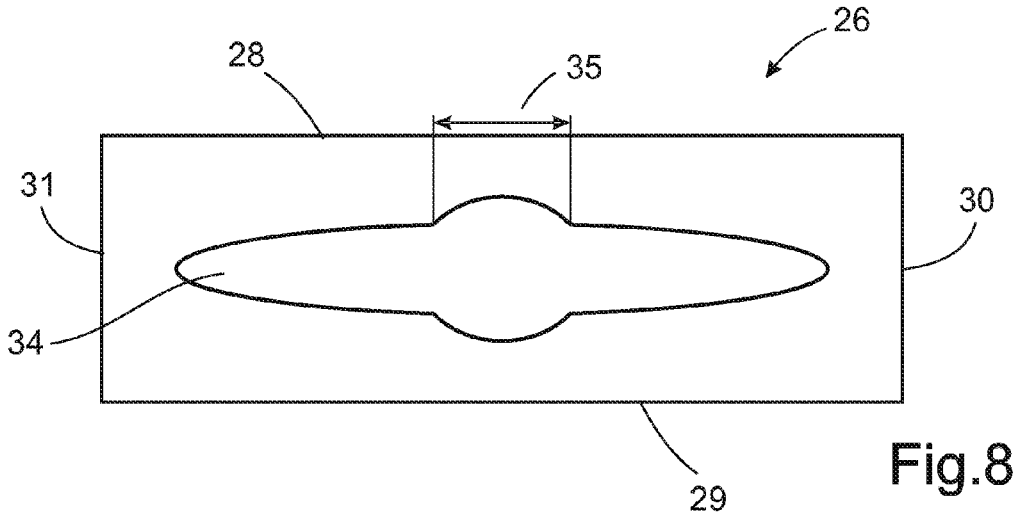
FIG. 8 schematically shows a dispenser opening of a sheet product dispenser according to an embodiment of the invention.

FIG. 8 schematically shows the dispensing opening 34 seen from the outside of the sheet product dispenser 26. The dispensing opening 34 in FIG. 8 exhibits a generally elongated rectangular or elliptical shape. A central region 35 of said dispensing opening 34 may be provided with an enlarged opening having a width in the direction of said elongation, which preferably is larger than said width of said package wrapper 3 for reduced sliding friction between the side surfaces of the dispensing opening and the package wrapper. The region 35 is not necessarily arranged centrally in said opening 34 but may be arranged offset from a centre. Moreover, there may be more than one region of said dispensing opening 34 having an enlarged opening.

The sheet product dispenser 26 is loaded by first providing a package 1 of folded sheet products, in particular hand wipes, made of tissue paper or nonwoven, which package 1 comprising a stack 2 of sheet products, and a package wrapper 3, which surrounds the stack 2 and holds the stack 2 together. The stack 2 comprises a start sheet product 4 at a start end 5 of the stack 2, and an end sheet product 6 at an opposite end 7 of the stack 2. The package wrapper 3 comprises a first end portion 12 and a second end portion 13, which end portions 11, 12 are mutually joined by first attachment means 15 at a first attachment location 14 where the end portions 11, 12 are overlapping with the first end portion 12 arranged outside the second end portion 13. The first attachment location 14 is arranged such that a release tab 19 for removal of the package wrapper 3 is formed by an end piece 18 of the first end portion 12. A free extremity 20 of the release tab 19 is arranged at the start end 5 of the package 1. The second end portion 13 of the package wrapper 3 is free from direct attachment to the stack 2.

The package 1 is arranged unopened within the sheet product dispenser 26, such the release tab 19 is accessible (to a user) when the start sheet product 4 is arranged next to the dispensing opening 34.

The release tab 19 is pulled and the package wrapper 3 is removed from the stack 2 via the dispensing opening 34.

Reference signs mentioned in the claims should not be seen as limiting the extent of the matter protected by the claims, and their sole function is to make claims easier to understand.

As will be realised, the invention is capable of modification in various obvious respects, all without departing from the scope of the appended claims. Accordingly, the drawings and the description thereto are to be regarded as illustrative in nature, and not restrictive.

REFERENCES

1. Package
2. Stack of sheet products
3. Package wrapper
4. Start sheet product
5. Start end of stack
6. End sheet product
7. Opposite end of stack
8. First long side of sheet products
9. Second long side of sheet products
10. First short side of sheet products
11. Second short side of sheet products
12. First end portion of package wrapper
13. Second end portion of package wrapper
14. First attachment location
15. First attachment means
16. Interior surface of package wrapper
17. Exterior surface of package wrapper
18. End piece of first end portion
19. Release tab
20. Free extremity
21. Second attachment location
22. Second attachment means
23. Third attachment location
24. Third attachment means
25. Outer surface of first end portion
26. Sheet product dispenser
27. Housing of dispenser
28. Front wall
29. Rear wall
30. First outer side wall
31. Second outer side wall
32. Upper wall
33. Support surface
34. Dispensing opening
35. Central region of dispensing opening

The invention claimed is:

1. A package of folded sheet products made of tissue paper or nonwoven, which package comprising a stack of said sheet products, and at least one package wrapper, which surrounds said stack and holds said stack together, said stack comprises a start sheet product at a start end of said stack, and an end sheet product at an opposite end of said stack, said at least one package wrapper comprises a first end portion and a second end portion, which end portions are mutually joined by a first attachment at a first attachment location where said end portions are in an overlapping relationship and with said first end portion arranged outside said second end portion, said first attachment location is arranged such that a release tab for removal of said at least one package wrapper is formed by an end piece of said first end portion, and a free extremity of said release tab is arranged at said start end of said stack, said second end portion of said at least one package wrapper is free from direct attachment to said stack, and said first end portion of said at least one package wrapper is joined with said start sheet product by a second attachment at a second attachment location.

2. The package according to claim 1, wherein said first attachment is configured to break upon exerting a pull force on said release tab, facilitating removal of said at least one package wrapper from said stack.

3. The package according to claim 1, wherein said at least one package wrapper is formed of a thin strip of material whose width is smaller than a width of the stack.

4. The package according to claim 1, wherein said first attachment location is arranged at said start end of said stack.

5. The package according to claim 1, wherein said first attachment location is arranged at a side surface of said stack that is formed by a long side of sheet products and associated with said second end portion of said at least one package wrapper.

6. The package according to claim 1, wherein said end piece of said first end portion is folded back and attached to an outer surface of said first end portion of said at least one package wrapper by a third attachment at a third attachment location for ensuring that said free extremity of said release tab is always arranged at said start end of said package.

7. The package according to claim 6, wherein said third attachment is configured to break prior to said first attachment upon exerting said pull force on said release tab.

8. The package according to claim 1, wherein any of said first attachment, means second attachment, and third attachment comprises an adhesive material.

9. The package according to claim 1, wherein each of said sheet products have an oblong rectangular shape with two opposite long sides and two opposite short sides, wherein said at least one package wrapper extends over either said short sides or said long sides.

10. The package according to claim 1, wherein said first attachment location is arranged at least 20 mm from said free extremity of said first end portion.

11. The package according to claim 1, wherein a height of said package is at least 15 cm.

12. The package according to claim 1, wherein said package is arranged to be placed within a sheet product dispenser with said start end facing a dispensing opening of said sheet product dispenser.

13. The package according to claim 1, wherein said first attachment location is arranged at least 35 mm from said free extremity of said first end portion.

14. The package according to claim 1, wherein said first attachment location is arranged at least 50 mm from said free extremity of said first end portion.

15. The package according to claim 1, wherein a height of said package is at least 20 cm.

16. A sheet product dispenser in combination with a package of folded sheet products according to claim 1, the sheet product dispenser comprising a housing for holding the stack of folded sheet products, wherein said housing comprising a front wall, a rear wall, two outer side walls, an upper wall and a support surface for said stack, and wherein a dispensing opening is provided in said upper wall or said support surface for dispensing said sheet products to a consumer, wherein said sheet product dispenser holds the package of folded sheet products according to claim 1.

17. The sheet product dispenser according to claim 16, wherein said dispensing opening exhibits a generally elongated rectangular or elliptical shape, and in that at least one region of said dispensing opening is provided with enlarged opening having a width in the direction of said elongation, which is larger than said width of said at least one package wrapper.

18. A method for filling a sheet product dispenser with folded sheet products, the method comprising the steps of:

providing a sheet product dispenser comprising a housing for holding a stack of folded sheet products, wherein said housing comprising a front wall, a rear wall, two outer side walls, an upper wall and a support surface for said stack, and wherein a dispensing opening is provided in said upper wall or said support surface for dispensing said sheet products to a consumer;

providing a package of folded sheet products made of tissue paper or nonwoven, which package comprising a stack of said sheet products, and at least one package wrapper, which surrounds said stack and holds said stack together, said stack comprises a start sheet product at a start end of said stack, and an end sheet product at an opposite end of said stack, said at least one package wrapper comprises a first end portion and a second end portion, which end portions are mutually joined by a first attachment at a first attachment location where said end portions are overlapping and with said first end portion arranged outside said second end portion, wherein said first attachment location is arranged such that a release tab for removal of said at least one package wrapper is formed by an end piece of said first end portion, wherein a free extremity of said release tab is arranged at said start end of said package, wherein said second end portion of said at least one package wrapper is free from direct attachment to said stack, and wherein said first end portion of said at least one package wrapper is joined with said start sheet product by second attachment means at a second attachment location;

arranging said package unopened within said sheet product dispenser, such said release tab is accessible to a user when said start sheet product is arranged next to said dispensing opening; and pulling said release tab and removing said at least one package wrapper from said stack via said dispensing opening.

* * * * *